US009976273B2

(12) United States Patent
Bartminn

(10) Patent No.: US 9,976,273 B2
(45) Date of Patent: May 22, 2018

(54) FOUNDATION OF AN OFFSHORE STRUCTURE

(71) Applicant: INNOGY SE, Essen (DE)

(72) Inventor: Daniel Bartminn, Elmshorn (DE)

(73) Assignee: Innogy SE, Essen (DE)

( * ) Notice: Subject to any disclaimer, the term of this patent is extended or adjusted under 35 U.S.C. 154(b) by 0 days. days.

(21) Appl. No.: 15/519,131

(22) PCT Filed: Oct. 12, 2015

(86) PCT No.: PCT/EP2015/073595

§ 371 (c)(1),
(2) Date: Apr. 14, 2017

(87) PCT Pub. No.: WO2016/059007

PCT Pub. Date: Apr. 21, 2016

(65) Prior Publication Data

US 2017/0233971 A1 Aug. 17, 2017

(30) Foreign Application Priority Data

Oct. 14, 2014 (DE) ..... 10 2014 220 782.7

(51) Int. Cl.
*E02B 17/02* (2006.01)
*E02D 27/52* (2006.01)
(Continued)

(52) U.S. Cl.
CPC ..... *E02D 5/40* (2013.01); *B63B 21/26* (2013.01); *B63B 21/50* (2013.01); *E02D 5/24* (2013.01);
(Continued)

(58) Field of Classification Search
CPC .... E02D 5/24; E02D 5/32; E02D 5/40; B63B 21/26; B63B 21/50
See application file for complete search history.

(56) References Cited

U.S. PATENT DOCUMENTS 6,488,446 B1 * 12/2002 Riemers ..... B63B 21/27 114/296
7,686,543 B2 * 3/2010 They ..... B63B 21/50 114/264
(Continued)

FOREIGN PATENT DOCUMENTS

DE 202007009474 U1 11/2008
EP 2011924 A2 * 1/2009 ..... E02B 17/0034
EP 2743170 A1 6/2014

OTHER PUBLICATIONS

PCT Notification of Transmittal of Translation of the International Preliminary Report on Patentability (Chapter I or II), dated, Apr. 20, 2017, in related International Patent Application No. PCT/EP2015/073595, filed Oct. 12, 2015.
(Continued)

*Primary Examiner* — Tara M. Pinnock
(74) *Attorney, Agent, or Firm* — Wiley Rein LLP

(57) ABSTRACT

A foundation system for the foundation of an offshore structure includes a monopile having an anchoring portion anchorable in a seabed and a connection portion disposed at the opposite end. A platform structure is connected directly to the connection portion of the monopile or indirectly via a transition piece. The platform structure is disposable above a water surface. The foundation system includes at least two stabilizing devices connected directly to the platform structure or indirectly to the platform structure via the transition piece. The stabilizing devices are attachable to the seabed such that tensile forces or compression forces are transmittable between the seabed and the platform structure. Securing points on the stabilizing devices, together with the connection portion of the monopile, define a plane having a horizontally extending component.

11 Claims, 2 Drawing Sheets

(51) Int. Cl.

| | |
|---|---|
| ***E02D 5/40*** | (2006.01) |
| ***B63B 21/26*** | (2006.01) |
| ***B63B 21/50*** | (2006.01) |
| ***E02D 5/24*** | (2006.01) |
| ***E02D 5/32*** | (2006.01) |
| *B63B 35/44* | (2006.01) |
| *E02D 27/42* | (2006.01) |

(52) U.S. Cl.
CPC ..... *E02D 5/32* (2013.01); *B63B 35/44* (2013.01); *E02D 27/425* (2013.01); *E02D 2300/0018* (2013.01); *E02D 2600/20* (2013.01)

(56) References Cited

U.S. PATENT DOCUMENTS

2012/0189390 A1* 7/2012 Belinsky ..... E02D 27/42 405/204
2015/0314834 A1* 11/2015 Prats Mustaros ..... B63B 21/50 405/223.1

OTHER PUBLICATIONS

International Search Report and Written Opinion dated Dec. 9, 2015 in International Patent Application No. PCT/EP/2015/073595 filed, Oct. 12, 2015.

* cited by examiner

FOUNDATION OF AN OFFSHORE STRUCTURE

RELATED APPLICATIONS

This Application is a National Stage Application of International Patent Application PCT/EP2015/073595, filed Oct. 12, 2015, which claims the priority benefit of German Patent Application No. 10 2014 220 782.7, filed Oct. 14, 2014, the entire contents of both of which are incorporated fully herein by reference for all purposes.

FIELD

The present invention relates to a foundation system for the foundation of an offshore structure. The invention additionally relates to a method for installing the foundation of an offshore structure, and to an offshore structure having a corresponding foundation system.

BACKGROUND

Offshore structures within the meaning of the present invention are, for example, transformer substations, wind turbines, or drilling or production platforms.

For particular types of foundation for offshore structures, in particular for offshore wind turbines, a piled foundation in the seabed is required. Commonly used foundation types are, for example, so-called monopiles, jackets, tripods or tripiles. Thus, jackets, for example, are framework structures of steel tubes, which have a triangular or quadrangular base and the upper end of which, following installation, projects out of the sea. A conventional wind turbine, a transformer substation or a drilling platform, for example, can be erected on a jacket.

In the case of a jacket foundation, in the operation of placing the piles the latter have to be positioned with a predefined spacing on the seabed, in the so-called "pre-piling" operation, this being effected by means of corresponding templates. This presupposes that the nature of the ground is such that all the piles to be placed can be driven as far as a predefined load-bearing ground horizon of the seabed. There are no possibilities for variation with respect to the spacing or siting or the placing of the piles.

In the case of a jacket foundation, a steel-lattice structure/steel-tube structure is then placed on the steel piles, the structure receiving a so-called "transition piece" above surface of the sea. The transition piece then receives the actual structure, for example in the form of a transformer substation.

To that extent, monopiles are preferably used in the installing of the foundation of wind turbines in water depths of up to 35 m, because this type of foundation is less elaborate. Usually, there is at least one transformer substation assigned to the wind turbine, positioned in immediate proximity to the wind turbine. In the transformer substation, the voltage generated by the wind turbine can be transformed, for example, from 33 kV to 155 kV and rectified, in order to be transmitted with low loss over large distances by means of high-voltage direct-current (HVDC) transmission systems.

It is also desirable to use monopiles for the foundation of transformer substations because, as already described above, they are very much easier to install than, for example, a jacket. Owing to the large extent and, in particular, owing to the large mass, of a transformer substation, of up to more than 1000 tons, the latter constitutes a large oscillatory mass in the case of installing the foundation on a monopile. The action of wind on the transformer substation and the action of wind and waves on the monopile result in excitation of oscillations of the entire structure, which oscillations on the one hand negatively affect the structural integrity of the monopile and of the transformer substation and, in addition, may cause nausea for personnel present on the transformer substation.

EP 2 743 170 A1 describes a platform structure having a platform and a floating structure, or buoyancy structure. In this case, the platform is connected to the seabed by means of tensioning cables.

DE 20 2007 009 474 U1 describes an offshore platform having a foundation pile, a transition piece, and a structure connection structure realized at the transition piece, wherein the transition piece is realized as a concrete construction.

SUMMARY

The present invention is therefore based on the object of providing a foundation system for offshore structures, by means of which foundations for offshore structures can be laid in a favorable and rapid manner and which, furthermore, have a high degree of stability, such that the offshore structures having foundations laid by means of the foundation system according to the invention have lesser oscillation amplitudes. In addition, the present invention is based on the object of providing an inexpensive and stable offshore structure that can be erected rapidly, and a method for erecting such an offshore structure.

These objects are achieved according to the invention by a foundation system having the features of claim 1, by an offshore structure having the features of claim 8, and by a method, for installing the foundation of an offshore structure, having the features of claim 9.

More precisely, the foundation system according to the invention for the foundation of an offshore structure comprises a monopile, having an anchoring portion that can be anchored in the seabed, and having a connection portion disposed at the opposite end. The foundation system additionally comprises a platform structure that can be connected directly to the connection portion of the monopile or connected indirectly via a transition piece, and that can be disposed above the surface of the water. The foundation system according to the invention is characterized in that it comprises at least two stabilizing devices, which can each be connected directly to the platform structure or connected indirectly to the platform structure via the transition piece and which can be brought into contact with the seabed, such that tensile and/or compression forces can be transmitted between the seabed and the platform structure by means of the stabilizing devices. In this case, when the foundation system is in the installed state, securing points of the stabilizing devices on the platform structure or on the transition piece, together with the connection portion of the monopile, define a plane having a horizontal component of extent.

The stabilizing devices may be disposed symmetrically in relation to the monopile or asymmetrically in relation to the monopile. In addition, the monopile may be disposed centrally or eccentrically in relation to the stabilizing devices.

Moreover, it is also possible for the foundation system to comprise at least three stabilizing devices, which can each be connected directly to the platform structure or indirectly via the transition piece and which can be brought into contact with the seabed. When the foundation system is in the installed state, the securing points of the stabilizing devices on the platform structure or on the transition piece then define a plane having a horizontal component of extent.

Because the securing points define a horizontal plane, or the plane defined by the securing points has a horizontal component of extent, horizontal swaying motion of the platform structure that are caused by horizontal forces (wind and waves) can be counteracted and reduced by means of the stabilizing devices. Moreover, owing to the provision of the stabilizing devices, the natural frequency of the offshore structure having a foundation laid by means of the foundation system according to the invention is increased in a region that is outside of the usual wave frequency spectrum, such that resonant build-up of oscillations of the offshore structure caused by wind and/or waves is avoided. Moreover, provision of the stabilizing devices has the effect that larger offshore structures can also have monopile foundations, without the need to accept a lesser stability of the offshore structure. It is therefore possible to avoid the necessity of using a jacket as a foundation for the offshore structure in order to achieve a desired stability. Installing the foundation of an offshore structure by use of a monopile is significantly easier, less time-consuming and less expensive than installing the foundation of an offshore structure by means of a jacket.

Because the securing points of the stabilizing devices on the platform structure or on the transition piece define a plane having a horizontal component of extent, this defined plane has a normal component that is parallel to the monopile.

Moreover, the mutual spacing of the securing points in relation to one another is preferably greater than the cross-sectional extent of the monopile. Greater stabilizing forces can thereby be transmitted to the platform structure by the stabilizing devices. The same applies to an indirect connection between the stabilizing devices and the platform structure. The stabilizing devices may be indirectly connected to the platform structure via a transition piece, i.e., via a coupling device.

If the foundation system comprises three stabilizing devices, then, in a plan view of the foundation system, the stabilizing devices and, more precisely, the securing points of the stabilizing devices on the platform structure and/or on the transition piece, are disposed at three corner points of a triangle. In the case of four stabilizing devices, in a plan view of the foundation system the contact points of the stabilizing devices on the platform structure and/or on the transition piece may be disposed at corner points of a rectangle or of a square or, in general, of a four-cornered polygon.

Merely the feature that the contact points of the stabilizing devices, together with the platform structure and/or with the transition piece, define a plane having a horizontal component of extent enables horizontal forces of any orientation to be absorbed by means of the stabilizing devices, such that excessive motion of the offshore structure is prevented by means of the stabilizing devices.

Preferably in this case, the stabilizing devices extend vertically from the platform structure and/or from the transition piece in the direction of the seabed. Owing to the vertical extent of the stabilizing devices, forces exerted upon the offshore structure by means of wind and/or waves can be absorbed particularly effectively by the stabilizing devices.

Preferably, the stabilizing devices are each realized as stabilizing pillars, which are displaceably connected to the platform structure and/or to the transition piece, and which can be lowered onto the seabed from the platform structure and/or the transition piece. The stabilizing pillars in this case can be locked to the platform structure and/or to the transition piece, such that axially oriented compression forces and transverse forces can be transmitted onto the seabed via the respective stabilizing pillars.

A corresponding realization of the foundation system offers the advantage that anchorages of the stabilizing devices in the seabed, or in the ground beneath the sea, are not absolutely necessary in order to counteract swaying motions of the offshore structure. The installation of the offshore structure in this case becomes very simple, because the offshore structure then only has to be set down on the monopile, or on a platform held by the monopile, and connected to the latter, whereupon the stabilizing pillars, for example mounted in guide sleeves, are lowered onto the seabed in order, following contact with the seabed, to be locked to the platform structure and/or to the transition piece.

Preferably, the stabilizing devices can each be connected to the seabed, such that tensile forces and compressive forces can be transmitted between the seabed and the platform structure by means of the respective stabilizing devices.

The respective connections in this case may be realized, for example, by means of anchorages. A corresponding realization of the foundation system further increases the stability of the offshore structure, because a swaying motion can be compensated by a stabilizing device loaded in compression and, disposed opposite the latter, a stabilizing devices loaded in tension.

Preferably, the stabilizing devices are each realized as flexible tensile elements, which can each be connected to the seabed.

A tensile element may be an anchor hawser, an anchor chain or an anchor cable or, quite generally, a flexible tensile element. Realization of the stabilizing devices as tensile elements offers the advantage that the platform structure and/or the coupling piece carrying the latter can be of a simple structural design, because there is no need for stabilizing pillars to be displaceably connected to the platform structure and/or to the transition piece.

For example, the tensile elements may be wound on a reel prior to fixing in the seabed, such that, following connection of the offshore structure to the monopile, or to the platform structure, the tensile elements are unwound from the reels until they are in contact with the seabed, whereupon the tensile elements are connected to the seabed in an appropriate manner.

Preferably, the foundation system comprises a number of foundation piles corresponding to the number of tensile elements, which foundation piles each comprise a drop anchor that is connected to one of the tensile elements, and which each comprise a column of grouting compound that is poured in situ within the seabed and that extends over a length within the seabed.

An anchor point, to which the tensile element is attached, can be set into the seabed by means of a drop anchor and at least one tensile element attached to the drop anchor.

The drop anchor is dimensioned, for example, in respect of its mass and in respect of its geometry, such that it penetrates the seabed to a predefined depth, owing to its kinetic energy in free fall. In so doing, the anchor takes along with it the anchor hawser attached to it, or the tensile element attached to it. One or more grouting-compound lines, which are likewise taken along by the drop anchor, may be fastened to the tensile element. A hardenable grouting compound, for example a concrete that can be hardened under water, is then injected into the injection channel, the tensile elements simultaneously serving to reinforce the column of grouting compound produced thus in situ.

There is provided as a drop anchor, within the meaning of the present invention, for example, a so-called torpedo pile, which has a torpedo-shaped main body having a penetrating tip, and which is provided at an end with a plurality of torpedo wings for the purpose of stabilization. The torpedo body may be, for example, of a hollow design, and comprise one or more ballast chambers that can be filled with a ballast.

A corresponding realization of the foundation system achieves the advantage that the structure to be erected can be guyed to one or more tensile elements, which guying clearly allows a certain latitude in the placing of the offshore structure, such that the setting of the foundation piles is not defined by a template or by the underwater configuration of the structure.

Moreover, in the case of a corresponding realization of the foundation system, there is no need for the piles to be set by means of ramming devices. The setting of the torpedo/drop anchor is a one-time operation, whereas the ramming of piles involves a recurring injection of sound into the marine environment. Clearly, it is also possible for a plurality of tensile elements to be attached to a drop anchor, although in the following one tensile element is discussed in each case.

As already mentioned above, a tensile element, within the meaning of the present invention, is a flexible tensile element that can transmit only tensile forces, but not compressive forces.

Preferably, the drop anchor is realized as a drop anchor that can be activated, wherein the drop anchor, when in an activated state, liquefies the seabed in close proximity to the drop anchor, such that penetration of the drop anchor into the seabed is assisted. An activated state of the drop anchor may be, in particular, a state in which the drop anchor vibrates, such that the seabed in close proximity to the drop anchor becomes liquefied. The anchor vibrations may be generated, upon dropping or upon striking on the seabed, by an internal, appropriately mounted unbalance mass, which is fixed to an internal suspension inside the drop anchor such that the internal oscillation frequency corresponds to the excitation frequency of the ground, typically in the range of 15-45 Hz.

Preferably, the foundation system comprises a protective casing that extends over a partial length of the column of grouting compound.

Further, preferably, the foundation pile comprises a sheet piling enclosure that extends over a partial length of the column of grouting compound.

In an advantageous design, the foundation system comprises a tensioning device, by means of which force can be applied to the tensile elements connected to the seabed. In a corresponding design of the foundation system, a yet greater stability of the offshore structure can be achieved.

Preferably, the platform structure is realized as a transformer substation facility, and/or the transformer substation facility comprises the platform structure.

The object on which the invention is based is additionally achieved by an offshore structure that comprises a foundation system described above, wherein the offshore structure is positioned on the monopile of the foundation system and connected to the latter, wherein the stabilizing devices are in contact with the seabed.

Clearly, all advantageous embodiments that are described in connection with the foundation system may also be advantageously embodiments of the offshore structure.

In addition, the object on which the invention is based is achieved by a method for installing the foundation of an offshore structure, wherein the method comprises the following method steps:

- anchoring an anchoring portion of a monopile in the seabed;
- disposing and connecting the offshore structure on the platform structure; and
- bringing the stabilizing devices into contact with the seabed.

Advantageously, the method for installing the foundation of an offshore structure by use of a foundation system that comprises a number of foundation piles corresponding to the number of tensile elements, which foundation piles each comprise a drop anchor that is connected to one of the tensile elements, and which each comprise a column of grouting compound that is poured in situ within the seabed and that extends over a length within the seabed, may comprise the following further method steps:

- providing and disposing a drop anchor at a predefined height above the seabed;
- fastening a tensile element to the drop anchor;
- fastening a grouting-compound line to the tensile element;
- dropping the drop anchor, such that it penetrates the seabed; and
- feeding a hardenable grouting compound into the injection channel produced by the drop anchor upon penetration of the seabed.

Referred to as an injection anchor, within the meaning of the present invention, is the displacement channel produced by the drop anchor as it goes into the sediment of the ground beneath the sea/seabed.

In comparison with conventional piled foundations, the method has the advantage, in particular, that the structure to be erected can be guyed to one or more tensile elements, which guying clearly allows a certain latitude in the placing of the offshore structure, such that the setting of the foundation piles is not defined by a template or by the underwater configuration of the structure.

In an advantageous variant of the method according to the present invention, it is provided that the grouting compound is fed into the injection channel over at least a partial length of the tensile element, the tensile element remaining in the hardened grouting compound. The tensile element in this case serves, on the one hand, to reinforce the grouting compound, and on the other hand to guy the offshore structure to be erected. In this case, the depth to be reached by the drop anchor is reduced, because the surface friction required to guy the main structure on the tensile element is reduced, and is provided by the body of grouting compound.

Expediently, prior to being dropped, the drop anchor is provided with ballast, the ballast mass being selected such that the drop anchor penetrates the seabed as far as load-bearing ground horizon.

In a particularly advantageous variant of the method, it is provided that the drop anchor is suspended on a drop rope, and dropping is effected by actuation of a release mechanism on the drop rope. In this case, the drop anchor is attached both to the drop rope and to one or more tensile elements.

Preferably, in the case of the method, the drop anchor may be put into the ground beneath the sea through a protective casing or a sheet piling enclosure, the protective casing or the sheet piling enclosure having been put in place beforehand. In order to facilitate penetration of the drop anchor into the ground beneath the sea, it may be provided that the seabed beneath the protective casing or within the sheet piling enclosure is fluidized by the injection of compressed air or water, before the drop anchor is dropped.

Alternatively, for example if a protective casing is used, it may be provided that the protective casing is pumped out before the drop anchor is dropped, such that the kinetic energy with which the drop anchor penetrates the seabed is increased significantly.

Alternatively, the protective casing, which may extend, for example, beyond the seabed, may be pumped full with a fluid, such that an increased hydrostatic pressure, which facilitates the penetration of the drop anchor into the ground beneath the sea, is built up at the bottom of the casing as a result of the column of fluid. The column of fluid may be set appropriately, for example in respect of its specific weight. For example, a barite solution may be used as a fluid.

BRIEF DESCRIPTION OF THE DRAWINGS

Further advantages, details and features of the invention are disclosed in the following by the exemplary embodiments explained. In detail.

DETAILED DESCRIPTION

In the description that now follows, components that are the same, or features that are the same, are denoted by the same references, such that a description concerning a component that is given with reference to a figure also applies to the other figures, such that repeated description is avoided.

Figure 1:
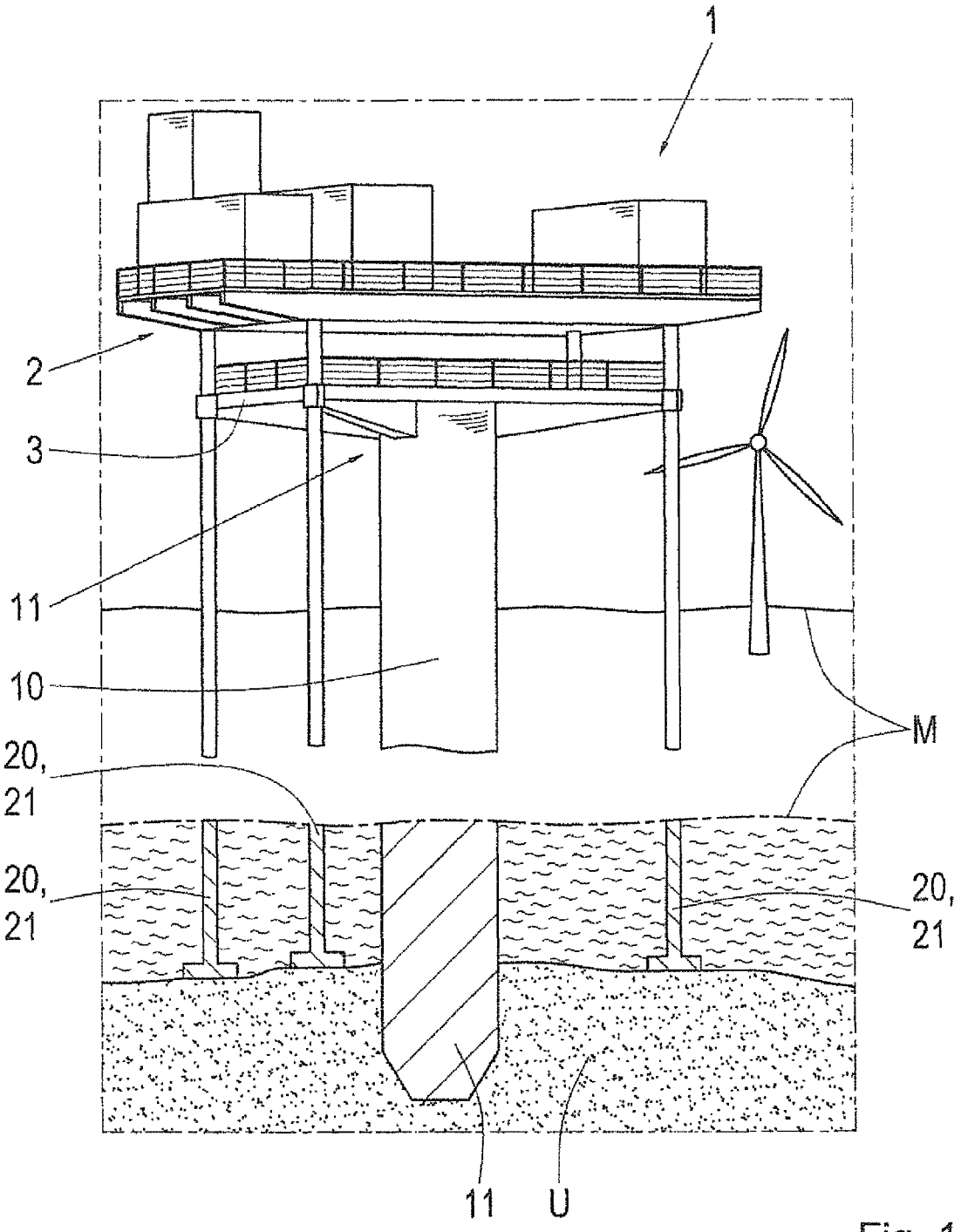
FIG. 1 shows a schematic representation of an offshore structure, the foundation of which is installed by means of the foundation system according to the invention.

Represented in FIG. 1 is an offshore structure 1, the foundation of which is installed on the seabed U by means of a foundation system according to the invention.

It can be seen from FIG. 1 that the foundation system has a monopole 10, having an anchoring portion 11 that can be anchored in the seabed U, and having a connection portion 12 that is opposite the anchoring portion 11. The anchoring portion 11 is set into the seabed U by, for example, ramming or pile jetting. The foundation system according to the invention additionally comprises a platform structure 3 that can be connected to the connection portion 12 of the monopile 10. In the exemplary embodiment represented, the platform structure 3 is connected directly to the monopile 10. It is also possible, however, for the platform structure 3 to be connected to a transition piece that is disposed between the monopile 10 and the platform structure 3. A corresponding transition piece is not represented in the figures.

It can additionally be seen from FIG. 1 that, placed on the platform structure 3, there is a connection structure 2 in the form of a transformer substation 2. The transformer substation 3 comprises a multiplicity of individual components, which easily cause the weight of the transformer substation to be increased to over 1000 tons.

However, the present invention is not limited to the connection structure 2 being realized in the form of a transformer substation 2. Thus, according to the invention, the connection structure 2 may also be realized as a wind turbine, or also as a drilling or production platform.

The foundation system according to the invention comprises at least two stabilizing devices 20. In the case of the exemplary embodiment represented in FIG. 1, the stabilizing devices 20 are realized as supporting feet, or as stabilizing pillars 21. The stabilizing pillars 21 are each connected directly to the platform structure 3, and can be lowered onto the seabed U. In the case of the installation represented in FIG. 1, the stabilizing pillars 21 have already been set down on the seabed U. The installation may be effected in such a manner that the platform structure 3 is placed on the connection portion 12 of the monopile 10, in which case, in this state, the stabilizing pillars 21 are in an upper position, in guide sleeves of the platform structure 3, such that they do not project downward in the direction of the seabed U. Following connection of the platform structure 3 to the monopile 10, the stabilizing pillars 21 are lowered onto the seabed U, such that they are in contact with the seabed U. The stabilizing pillars 21 are then locked to the platform structure 3, such that shear forces can be transmitted onto the seabed U via the respective stabilizing pillars 21.

Because the guide sleeves on the platform structure 3 are spaced apart from each other in such a manner that they define a plane having a horizontal component of extent, in the present example a horizontal plane, and the stabilizing pillars 21 are disposed at the four corner points of the platform structure 3, horizontal forces that act on the monopile 10 or on the transformer substation 2 can be absorbed by the stabilizing pillars 21. This horizontal action of force may be caused, for example, by wind acting on the monopile 10 and on the transformer substation 2. In addition, horizontal forces due to waves or ship wash are transmitted to the monopile 10.

Swaying motions of the offshore structure 1, having a foundation installed thus, is consequently counteracted in a reliable manner by the stabilizing pillars 21. The stabilizing pillars 21 also have the effect that the oscillation frequency of the offshore structure is altered in such a manner that the latter is outside of the usual wave frequency spectrum. The resonant frequency of the offshore structure 1 having a foundation installed by means of the foundation system according to the invention is above 0.25 Hz, and usually also above 0.3 Hz.

In the exemplary embodiment represented, the stabilizing pillars 21 are not connected to the seabed U, or not anchored therein. It is also possible, however, for the stabilizing pillars 21 to be connected to the seabed U, in particular anchored, such that not only compressive forces, but also tensile forces, can be transmitted between the seabed U and the platform structure 3 via the stabilizing pillars 21. A corresponding realization of the foundation system further increases the stability because, in the case of action of force, a stabilizing pillar 21 can absorb compressive forces, and another stabilizing pillar 21, opposite this stabilizing pillar 21, can absorb tensile forces.

Figure 2:
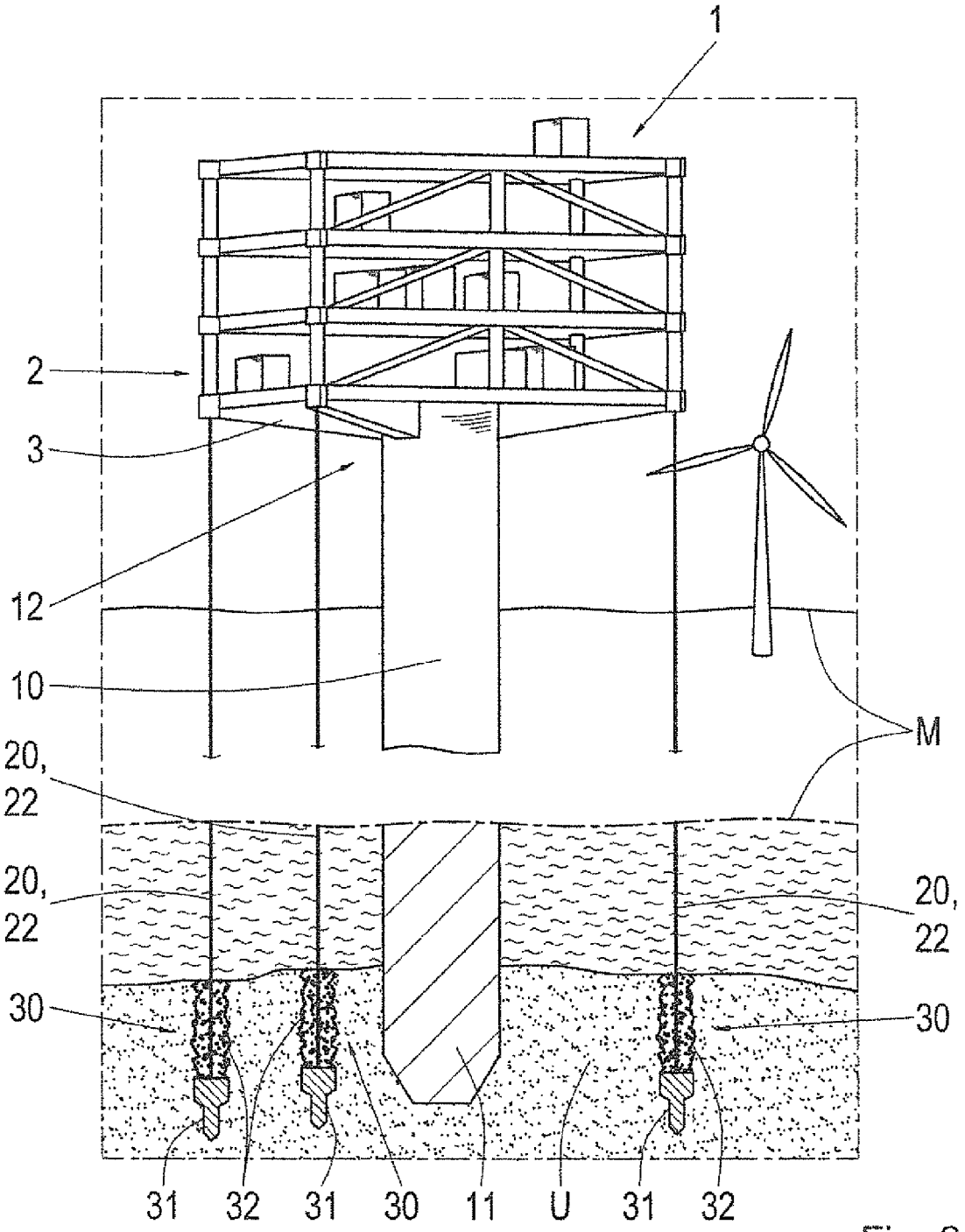
FIG. 2 shows an offshore structure that is installed by means of a foundation system according to an alternative embodiment of the present invention.

Represented in FIG. 2 is an offshore structure 1, the foundation of which is installed on the seabed U by means of a foundation system according to a further embodiment of the present invention. The stabilizing devices 20 in this case are realized as flexible tensile elements 22, which can be connected to the seabed U. Tensile elements 22, within the meaning of the present invention, are anchor hawsers 22, anchor cables 22, anchor chains 22 or, quite generally, flexible tensile elements 22. Flexible tensile elements 22, within the meaning of the present invention, are tensile elements via which tensile force, but not shear forces, can be transmitted.

In the case of the exemplary embodiment represented in FIG. 2, there are four tensile elements 22, each connected to the seabed U, which are provided at four corners of the platform structure 3.

In the case of the exemplary embodiment represented, the foundation system also comprises four drop anchors 31 in the form of four torpedo piles 31, which are each connected to a tensile element 22. The drop anchors 31 are part of foundation piles 30, which, in addition to the drop anchor 31, comprise columns of grouting compound 32.

The installation of the foundation system proceeds in such a manner that, following connection of the platform structure 3 to the connection portion 12 of the monopile 10, the respective drop anchors 31, with tensile elements 22 connected thereto, are let drop into the seabed U from a predefined height, such that the drop anchors 31 form an injection channel. A hardenable grouting compound, which forms the columns of grouting compound 32 represented in FIG. 2 is then fed into this injection channel.

Consequently, only tensile forces can be transmitted via the tensile elements 22, with horizontal forces from any direction being able to be compensated, owing to the arrangement of the securing points of the tensile elements 22 on the platform structure 3, because the securing points of the tensile elements 22 on the platform structure 3 define a plane having a horizontal component of extent.

Preferably, the foundation system additionally comprises a tensioning device, not represented in FIG. 2, by means of which the tensile elements 22 can be tensioned, as a result of which the stability of the offshore structure 1 having a foundation installed by means of the foundation system is further increased.

LIST OF REFERENCES

1 offshore structure
2 topside/connection structure/transformer substation
3 platform structure/platform
10 monopile
11 anchoring portion (of the monopile)
12 connection portion (of the monopile)
20 stabilizing device
21 stabilizing pillar/stabilizing device
22 tensile element/anchor hawser/anchor chain/anchor cable/ stabilizing device
30 foundation pile
31 drop anchor/torpedo pile
32 column of grouting compound
M sea level/surface of sea
U seabed/ground beneath the sea

The invention claimed is:

1. A foundation system for the foundation of an offshore structure, comprising:

a monopile, having an anchoring portion anchorable in a seabed, and having a connection portion disposed at an end opposite the anchoring portion; and a platform structure configured for connection at least one of directly to the connection portion of the monopile and indirectly via a transition piece, wherein the platform structure is disposable above a water surface, the foundation system comprising:

at least two stabilizing devices configured for connection to at least one of directly to the platform structure and indirectly to the platform structure via the transition piece, wherein the at least two stabilizing devices are attachable to the seabed, such that at least one of tensile forces and compression forces are transmittable between the seabed and the platform structure, wherein the stabilizing devices comprise securing points, wherein, together with the connection portion of the monopile, the securing points define a plane having a horizontally extending component.

2. The foundation system of claim 1, wherein the at least two stabilizing devices are each stabilizing pillars configured for displaceable connection to at least one of the platform structure and the transition piece, wherein the at least two stabilizing devices are lowerable onto the seabed from at least one of the platform structure and the transition piece; and the stabilizing pillars are configured to lock to at least one of the platform structure and the transition piece, such that axially oriented compression forces are transmitted thereby to the seabed.

3. The foundation system of claim 1, wherein the at least two stabilizing devices are configured for connection to the seabed, such that tensile forces are transmitted thereby to the seabed.

4. The foundation system of claim 1, wherein the at least two stabilizing devices are each flexible, tensile elements configured for connection to the seabed.

5. The foundation system of claim 4, further comprising a plurality of foundation piles equal in number to the tensile elements, wherein the plurality of foundation piles each comprise a drop anchor connectable to one of the tensile elements, and wherein each drop anchor comprises a column of grouting compound, poured in situ, having a length within the seabed.

6. The foundation system of claim 5, wherein the drop anchor further comprises a mechanism that, when activated, liquefies the seabed in close proximity to the drop anchor, to assist with penetration of the drop anchor into the seabed.

7. The foundation system of claims 4, further comprising a tensioning device configured to apply a force to the tensile elements when the tensile elements are connected to the seabed.

8. The foundation system of claim 1, wherein the platform structure comprises a transformer substation facility.

9. An offshore structure, comprising the foundation system of claim 1, wherein the offshore structure is positioned on the monopile and the at least two stabilizing devices are connected to the seabed.

10. A method for installing a foundation of an offshore structure, comprising:

providing a monopile having an anchoring portion anchorable in a seabed and a connection portion disposed at an opposite end;

providing a platform structure connectable to at least one of directly to the connection portion and indirectly via a transition piece wherein the platform structure is disposable above a water surface;

anchoring the anchoring portion in the seabed;

disposing the offshore structure on the platform structure;

providing at least two stabilizing devices that are connectable at least one of directly to the platform structure and indirectly to the platform structure via the transition piece and that are contactable with the seabed such that at least one or tensile and compression forces are transmitted between the seabed and the platform structure, wherein, when the foundation system is in the installed state, securing points of the at least two stabilizing devices, together with the connection portion, define a plane having a horizontally extending component; and bringing the stabilizing devices into contact with the seabed.

11. The method of claim 10 further comprising providing and disposing a drop anchor at a predefined height above the seabed;

fastening a tensile element to the drop anchor;

fastening a grouting-compound line to the tensile element;

dropping the drop anchor, such that it penetrates the seabed; and feeding a hardenable grouting compound into an injection channel produced by the drop anchor upon penetration of the seabed.

* * * * *